United States Patent [19]

Schlicht et al.

[11] 4,185,965

[45] Jan. 29, 1980

[54] AMINE DERIVATIVES OF HYDROCARBYL LACTAM CARBOXYLIC ACIDS AS FUEL ADDITIVES

[75] Inventors: Raymond C. Schlicht; William M. Cummings, both of Fishkill, N.Y.

[73] Assignee: Texaco Inc., White Plains, N.Y.

[21] Appl. No.: 865,062

[22] Filed: Dec. 27, 1977

[51] Int. Cl.[2] ..... C10L 1/18; C10L 1/22

[52] U.S. Cl. ..... 44/63; 44/71; 252/51.5 R

[58] Field of Search ..... 44/63, 71; 252/51.5 R; 548/348; 544/333

[56] References Cited

U.S. PATENT DOCUMENTS

| | | | |
|---|---|---|---|
| 3,138,610 | 6/1964 | Buc | 44/63 |
| 4,070,370 | 1/1978 | Elliott et al. | 548/348 |

*Primary Examiner*—Winston A. Douglas
*Assistant Examiner*—J. V. Howard
*Attorney, Agent, or Firm*—Robert A. Kulason; Carl G. Ries; James J. O'Loughlin

[57] ABSTRACT

This invention relates to motor fuel compositions containing dihydroimidazoline, tetrahydropyrimidine and amide derivatives of hydrocarbyl substituted lactam acids.

19 Claims, No Drawings

AMINE DERIVATIVES OF HYDROCARBYL LACTAM CARBOXYLIC ACIDS AS FUEL ADDITIVES

BACKGROUND OF THE INVENTION

There exists a constant demand for improved lubricating oil compositions and lubricant oils to meet different and ever changing demands. In large measure these demands and evolving needs are an outgrowth of evolving governmental regulations and standards, directed, in a particular manifestation, to engine exhaust gas emissions, which have resulted in differences in engine design and construction. A major change in engine design recently adapted in this context, and by way of illustration, is the feeding of blow-by gases from the crankcase of an internal combustion engine into the intake air supply of the carburetor rather than venting these gases to the atmosphere as in the past. A further change being adopted involves the recycling of a part of the exhaust gases to the combustion zone of the engine in order to effect a more complete combustion and thus reduce objectionable exhaust emissions. However, the recycled exhaust gases contain substantial amounts of engine deposit-forming materials, which promote sludge formation particularly about the throttle plate area of the carburetor restricting air flow so that over-rich fuel mixture results. This condition produces rough engine idling, stalling, and, at the same time, enhances exhaust emissions which the novel design was intended to obviate.

In addition, while modern gasoline compositions are highly refined products they contain minor amounts of impurities that promote corrosion in bulk fuel carriers, storage and fuel tanks, and engine carburetors.

An acceptable motor fuel contains additives addressed to correcting or inhibiting these disabling characteristics of motor fuels. Thus, the discovery of novel and compatible motor fuel additives capable of general application and selective modification to accommodate changing demands while combining good detergency properties with effective corrosion inhibition would provide a material advance in the state of the art.

SUMMARY OF THE INVENTION

Accordingly, it is an object of the invention to provide novel fuel additives efficacious against sludge formation and corrosion in places where motor fuels are used or stored.

It is a further object of this invention to provide fuel additives which, while capable of general application, may also be selectively applied in response to particular needs.

Other objects and advantages of this invention will become evident from the following description.

Thus, it has now been discovered that certain 3-amido, and 3-tetrahydropyrimidyl and, particularly, 3-dihydroimidazolinyl derivatives of hydrocarbyl substituted butyrolactams are possessed of efficacious detergent and acid corrosion inhibiting properties when incorporated in gasoline formulations used in internal combustion engines.

DESCRIPTION OF THE PREFERRED EMBODIMENTS

The amide and polyamino heterocyclic derivatives of lactam carboxylic acids useful either separately or as mixtures in the practice of the invention are characterized by the formula:

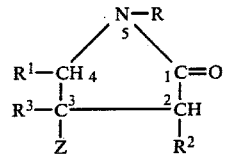

(I)

wherein Z is a nitrogen-containing moiety of the formulae:

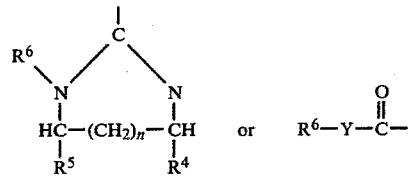

where, in the foregoing formulae, R is a hydrocarbyl radical, including an alkyl, aryl, alkaryl or aralkyl radical, or a mono-or di-substituted aminoalkyl radical wherein said alkyl moieties contain from 1 to 12, and preferably 1 to 7, carbon atoms, R is, most desirably, a lower alkyl radical of from 1 to 7 carbon atoms, or an N-butyrolactam alkyl radical in which said alkyl moiety contains from 1 to 12, and preferably 2 to 6, carbon atoms, and said lactam radical contains, in addition, the substituents $R^1$, $R^2$ and $R^3$ having the values provided herein; $R^1$ is a hydrogen atom or a hydrocarbyl radical and desirably one of from 1 to 20 carbon atoms, including an alkyl, aryl, aralky or alkaryl radical and preferably a phenyl radical; each of $R^2$ and $R^3$ is a hydrogen atom or a hydrocarbyl radical, and preferably an alkenyl radical, of from 8 to 500, and most desirably 10 to 300 carbon atoms, provided that only one of $R^2$ and $R^3$ is hydrogen and only one a hydrocarbyl radical; n has a value of from 0 to 1 inclusive, each of $R^4$ and $R^5$ is preferably a hydrogen atom or, if desired, a hydrocarbyl radical, illustratively, of from 1 to 25 carbon atoms, that is, an alkyl, aryl, alkaryl or aralkyl radical; and $R^6$ is any of the radicals represented by each of $R^4$ and $R^5$ or, and indeed preferably, hydrogen or an aminoalkyl or polyazaalkyl radical of the formula:

$$-(C_mH_{2m}NH)_pH$$

wherein m has a value of from 1 to 6 (and preferably 2 to 6) and p has a value of from 1 to 10; and Y is an ethylene or propylene diamino radical having the structure $-NH(C_b\ H_{2b})NH-$, wherein b is an integer of from 2 to 3, inclusive. The foregoing radicals characterized as "hydrocarbyl" are intended to include one or more substituents from which active hydrogen atoms are absent; including alkoxyl, nitro, nitrile, carboalkoxy, and tertiary amino (and particularly dimethylamino) moieties; and which are, with respect to those of the foregoing moieties occurring as substituents in the radicals represented by R, $R^1$, $R^2$ and $R^3$, less reactive, in any event, than an imino groups.

Significantly preferred products of the present invention are those of the general formula:

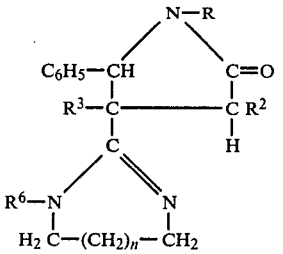

(V)

wherein R is a lower alkyl (and most desirably, methyl), an N,N-dialkylaminoalkyl moiety, wherein the alkyl moieties are lower alkyl or a N-[3-dihydroimidazolin-2'-yl)-4-phenyl] butyrolactam alkyl moiety containing an alkenyl radical of from 10 to 300 carbon atoms in the 2-carbon or 3-carbon position of the lactam ring; and $R^6$ in the polyamino heterocyclic ring is hydrogen or a moiety of the formula:

$$-(C_mH_{2m}NH)_kH$$

wherein m has the value assigned above and k is an integer of from 1 to 3 inclusive.

These preferred products are prepared from the appropriate corresponding lactam acids and polyamines, as described herein.

Illustrative of the preferred products coming within the purview of this invention are 3-polybutenyl-3-dihydroimidazolin-2'-yl-4-phenyl-5-methyl butyrolactam; 3-dodecenyl-3-dihydroimidazolin-2'-yl-4-phenyl-5-methyl butyrolactam; 2-dodecenyl-3-dihydroimidazolin-2'-yl-4-phenyl-5-methyl butyrolactam; 3-octadecyl 3-tetrahydropyrimidin-2'-yl-4-phenyl-5-methyl butyrolactam; ethylene bis-(2-polybutenyl-3-tetrahydropyrimidin-2'yl-4-phenyl) butyrolactam; 3-dodecenyl-3-tetrahydropyrimidin-2'-yl-4-phenyl-5-methyl butyrolactam; and isomeric mixtures thereof.

Lactam acids reactants for use in preparing the products of the invention are, illustratively, 2-polybutenyl-3-carboxy-4-phenyl-5-methyl butyrolactam; 3-dodecenyl-3-carboxy-4-phenyl-5-methyl butyrolactam; 2-dodecenyl-3-carboxy-4-phenyl-5-methyl butyrolactam; 3-polybutenyl-3-carboxy-4-phenyl-5-methyl butyrolactam; 2-polyisobutenyl-3-carboxy-4-phenyl-5-(N,N-dimethylaminoethyl) butyrolactam; 2-octadecenyl-3-carboxyl-4-phenyl-5-(N,N-dimethylaminoethyl) butyrolactam; 1',2'-ethylene-bis-[(3-polybutenyl-3-carboxy-4-phenyl) butyrolactam-5]; 1',6'-hexylene-bis-[(2-dodecenyl-3-carboxy-4-phenyl) butyrolactam-5]; 1',6'-hexylene-bis-[N-(2-polybutenyl-3-carboxy-4-phenyl)butyrolactam-5]; and isomeric mixtures thereof. The polybutenyl and polyisobutenyl substituents referred to throughout this specification refer to alkyl groups having average molecular weights of about 1000 to 1500, for example, 1290, and about 70 to 75 carbon atoms.

The conventional products of the invention are prepared by reaction of a lactam carboxylic acid or carboxybutyrolactam as also characterized, produced by the process described in copending application of Raymond C. Schlicht, one of the applicants herein, filed on even date herewith and entitled "*Lactam Carboxylic Acids, Their Method of Preparation and Use.*" The preparation of the foregoing lactam carboxylic acids by reaction of an imine and preferably and hydrocarbyl succinic anhydride is described in a further copending application of Raymond C. Schlicht, also filed on even date herein. Both of the foregoing copending applications are incorporated by reference herein.

In general, the amine derivatives of the foregoing lactam carboxylic acids are prepared, as described in the former of the two copending applications, by reaction of a 3-carboxybutyrolactam (or lactam carboxylic acid) of the formula:

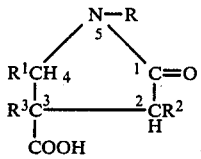

(II)

wherein each of R, $R^1$, $R^2$ and $R^3$ has the value assigned hereinabove, with an alkylene, or polyalkylene, polyamine of the general formula:

$$H(NHC_rH_{2r})_qNH\text{-}(W) \qquad \text{III}$$

wherein W is a hydrocarbyl radical or preferably an aminoalkyl or polyazaalkyl moiety of the formula:

$$-(C_mH_{2m}NH)_pH$$

and m is an integer of from 1 to 6, and preferably 2 to 6; r is an integer of from 2 to 3 inclusive; p has a value of from 0 to 10; and q is an integer of from 1 to 10; the sum of p and q not exceeding a value of 10.

The reaction of carboxybutyrolactam (or lactam carboxylic acid) and polyamine takes place at a temperature in the range of 0° C. to 250° C., desirably within the range of 60° to 200° C., and preferably at 100° C. to 180° C.; optionally, in the presence of an inert organic solvent such as benzene, hexane, heptane, octane, isooctane, toluene, xylene or other inert solvents and, most desirably, in an inert atmosphere and at ambient pressure. The amide-substituted lactams are formed as intermediates when one mol of water is evolved for each carboxylic acid moiety present in the butyrolactam or lactam carboxylic acid of the reaction mixture. A yield of two mols of water for each mol of reactant lactam carboxylic acid indicates that the reaction has gone to completion.

The polyamine and lactam acid are reacted in a mole ratio of 1 mole of polyamine for each lactam acid moiety present. Thus, 1 mole of amine is utilized preferably in reaction with each ½ mole of bis-lactam carboxylic acid; whereas 1 mole of amine will suffice for each mole of lactam acid containing a single carboxyl group. The foregoing molar relationships are intended to describe the least amount of polyamine that will react with all of the lactam carboxylic acid added to the reaction. Lesser amounts, and indeed, molar amounts in excess of those recited can also be employed.

The desired diazole (dihydroimidazole) and diazine (tetrahydropyrimidine) products are conveniently recovered without separation from minor amounts of the intermediate amides; however solvent, where present, unreacted starting compounds and water of reaction by are removed by conventional means including refluxing for removal of water and excess polyamine, cooling, filtration and vacuum stripping. The resultant residue is predominantly composed of an isomeric mixture of the desired lactams products containing an alkenyl (or other appropriate) substituent in the 2-carbon and 3-carbon positions of the lactam nucleus.

Whether employed in the formulation of motor fuels (or indeed, as oils, as described in the foregoing copending applications of Raymond C. Schlicht) as the reaction product mixtures, as is most economic, or as isolated compounds, including isomeric mixtures thereof, the particularly preferred compounds and those occurring predominantly or exclusively in any reaction product mixture (where the reaction is carried to completion) are the dihydroimidazoline or tetrahydropyrimidine-butyrolactam derivatives of Formulae I and II hereinabove. While perfectly feasible, in terms of the present invention, it will be evident that the tetrahydropyrimidines and dihydroimidazolines butyrolactam derivatives will occur in admixture only where a mixture of polyamines containing ethylene and propylene linkages between the nitrogens thereof are reacted with the lactam acid. On the other hand, the amide derivatives of Formula I, occur as intermediates in the formulation of the dihydroimidazoline or tetrahydropyrimidine derivatives of Formula I and concentration of amide can be controlled by stopping the reaction after evolution of a portion of the total expected water of reaction, as noted above, or by carrying the reaction to completion.

The prescribed compounds or isomeric mixture thereof or reaction product mixtures of the foregoing are employed as gasoline motor fuel compositions in a concentration to provide both effective carburetor detergency and corrosion inhibiting properties. In general, an effective concentration of the additive ranges from about 0.001 to 0.1 weight percent with a preferred concentration ranging from about 0.01 to 0.075 weight percent. The limits of the preferred range correspond respectively to about 25 to 200 PTB (pounds of additive per 1000 barrels of gasoline).

Any gasoline suitable for a spark-ignited, internal combustion engine can be used in the practice of this invention. In general, the base fuel will consist of a mixture of hydrocarbons in the gasoline boiling range, i.e., boiling from about 75° F. to 450° F. A boiling range of 75° F. to 900° F. also defines a desirable range of products for lubricant oil purposes. The hydrocarbon components can consist of paraffinic naphthenic, aromatic and olefinic hydrocarbons. The gasoline can be obtained naturally or it can be produced by thermal or catalytic cracking and/or reforming of petroleum hydrocarbons. The base fuel will generally have a Research Octane Number above 80 and up to 102 with the preferred range being from about 85 to 100.

The following examples are further illustrative of the invention.

Examples I and II below illustrate the preparation of a mixture containing predominantly and respectively 2(3)-polybutenyl-3-(1'aminoethyl dihydroimidazolin-2'-yl)-4-phenyl-5-methyl butyrolactam and 2(3)-polybutenyl-3-(1'-[3,6,9-triazanonyl] dihydroimidazolin-2'-yl)-4-phenyl-5-methyl butyrolactam for use in the motor fuels of the invention.

EXAMPLE I

2(3)-Polybutenyl-3-carboxy-4-phenyl-5-methyl butyrolactam (wherein the polybutenyl group has an average molecular weight of about 1290 and is composed of 85–98 weight percent, of high molecular weight mono-olefins, the balance, isoparaffins, was reacted in an amount of 1350 grams (equivalent of 0.645 mole basis theory) with 66.5 grams (0.645 mole) of diethylene triamine in 600 ml. of xylene as solvent. After 16 hours of refluxing at 155° C., 22.6 ml. of water phase was collected (as against a theoretical recovery of 23.2 mil for the dihydroimidazoline).

The reaction mixture was cooled, diluted, filtered and stripped in the manner described in Example I and the product including predominantly (i.e. from at least 60 wt.% to about 80 wt.% of) the isomeric mixture, 2(3)-polybutenyl-3-(1'-aminoethyl dihydroimidazolin-2'-yl)-4-phenyl-5-methyl butyrolactam, was recovered in an amount of 139 grams.

Analysis of the product was as follows:

| Test | Calculated | Found |
|---|---|---|
| % N. | 2.59 | 1.99 |
| % basic N(byHCl $O_4$ titration) | 1.3 | 0.8 |

EXAMPLE II

To 1930 grams (equivalent to 0.96 mole) of 2(3)-polybutenyl-3-carboxy-4-phenyl-5-methyl butyrolactam was added 181 grams (0.96 mole) of the tetraethylene pentamine in 400 ml. of xylene. After refluxing for 19 hours at 30° to 177° C. with removal of the water of reaction, the product was diluted with 1500 ml. of n-heptane, filtered and stripped to 150° C. at 15 mm. Hg pressure.

A yield of product amounting to 2081 grams was secured. This product was redissolved in 6000 ml. of heptane and then extracted with two separate 500 ml. portions of methanol. The heptane raffinate was then stripped to 150° C. at 15 mm. pressure. The product recovered included predominantly the isomeric mixture, 2(3)-polybutenyl-3-[1'-(3,6,9-triazanonyl)-imidazolin-2'yl]-4-phenyl-5-methyl butyrolactam. Recovery in the extraction was 90 weight percent. The analysis secured was as follows:

| | | Found | |
|---|---|---|---|
| Test | Calculated | Before Extraction | After Extraction |
| % N | 3.88 | 3.96 | 2.06 |
| TBN | 104 | 82 | 39 |

EXAMPLE III

The additive compositions prepared as described in Examples I and II were tested for their corrosion inhibiting properties using the Colonial Pipeline Rust Test, the procedure for which is as follows:

A steel spindle, 3 3/16 inches long and ½ inch wide, made from ASTM D-665-60 steel polished with Crystal Bay fine emery paper, is placed in a 400 cc beaker with 300 cc of fuel sample, which is maintained at 100° F. for one-half hour. Then 30 cc of distilled water is added. The beaker and contents are kept at 100° F. for 3½ hours. The spindle is thereafter visually inspected and the percentage of rusted surface area is estimated.

The Base Fuel, designated Base Fuel A, employed in the following examples was a premium grade gasoline having a Research Octane Number of about 100 and contained 3 cc. of tetraethyl lead per gallon. This gasoline consisted of about 25 percent aromatic hydrocarbons, 10 percent olefinic hydrocarbons and 65 percent paraffinic hydrocarbons and boiled in the range from about 90° F. to 380° F. The results secured in performing the foregoing test procedure with the products of Examples I and II are shown in Table I as follows:

Table I

| Colonial Pipeline Rust Test | | |
|---|---|---|
| Additive Composition | Concentration | % Rust |
| Example | | |
| I | Base Fuel A+25 PTB* | 1-5** |
| II | Base Fuel A+25 PTB* | 1-5** |

*Pounds of additive composition per 1000 gallons of gasoline.
**An effective corrosion inhibition was found to exist as a result at the levels tested.

EXAMPLE IV

The additive compositions prepared as described in Examples I and II were tested for their carburetor detergency properties against a standard commercially available gasoline motor fuel (hereinafter referred to as the "Control Fuel") containing 173 PTB of a polyisobutenyl diamine used for carburetor detergency, wherein the polyisobutenyl moiety had an average molecular weight of about 1290. For this purpose, the additive compositions of Example I and Example II were incorporated in the base fuel designated Base Fuel A of Example III and subjected to the Chevrolet Carburetor Detergency Test described hereinafter. The results of this test procedure in which duplicate runs of the mixture of Base Fuel A and the indicated additives were subjected to testing, are recited in Table II appearing hereinafter. For comparison, it is noted that the Control Fuel washed down in the test procedure of this example from 60 percent by weight to 80 percent by weight of the preformed deposits. It is noted, too, in this context that the detergent additive of the Control Fuel is present in a concentration in excess of three times that of the additives of the invention in the Base Fuel A as shown by the recitation of Table II.

CHEVROLET CARBURETOR DETERGENCY TEST

This test is run on a Chevrolet V-8 engine mounted on a test stand using a modified four-barrel carburetor. The two secondary barrels of the carburetor are sealed and feed to each of the primary barrels arranged so that separate fuels can be run in each barrel simultaneously. The primary carburetor barrels are also modified so that they have removable aluminum inserts in the throttle plate area in order that deposits formed on the inserts in this area can be conveniently weighed.

In the procedure designed to determine the effectiveness of an additive fuel to remove preformed deposits in the carburetor, the engine is run for a period of time, usually 24 to 48 hours, using the base fuel as the feed to both barrels with engine blow-by circulated to the air inlet of the carburetor. The weight of the deposits on both sleeves is determined and recorded. The engine is then cycled for 24 additional hours with the reference Control Fuel being fed to one barrel, the additive fuel of the invention to the other, and no blow-by to the carburetor air inlet. The inserts are then removed from the carburetor and weighed to determine the difference between the performance of the additive fuel of the invention and Control Fuel in removing the preformed deposits. After the aluminum inserts are cleaned, they are replaced in the carburetor and the process repeated with the fuels reversed in the carburetor to minimize differences in fuel distribution and barrel construction. The effectiveness of the additive fuel of the invention is expressed as the difference (Δ) between deposit removed by the additive fuel and the deposit removed by base fuel. When Δ is positive, the additive fuel has removed more deposit than the reference fuel (Control Fuel).

The Control Fuel used as a standard for comparison purposes in this test is a commercial high octane premium gasoline carburetor detergent and is considered by those skilled in the art to be highly effective. The results of this test are reported by the difference in carburetor deposits removed by the additive containing gasoline of the invention in comparison to the commercial premium detergent gasoline.

Table II

| Chevrolet Carburetor Detergency Test | | | |
|---|---|---|---|
| Additive Composition of Example | Concentration in PTB | % Deposit Removal Run No. 1 | 2 |
| I | 75 | −3 | −30 |
| II | 75 | −19 | −15 |

The foregoing tests demonstrate in context the outstanding carburetor detergency properties of the fuel compositions of the invention.

It will be evident that the terms and expressions which have been employed are used as terms of description and not of limitation. There is no intention in the use of such terms and expressions of excluding equivalents of the features shown and described or portions thereof, and it is recognized that various modifications are possible within the scope of the invention claimed.

What is claimed is:

1. A motor fuel composition comprising a mixture of hydrocarbons in the gasoline boiling range and an additive mixture including, in a concentration of from 0.001 to 0.1 weight percent, a substituted butyrolactam of the formula:

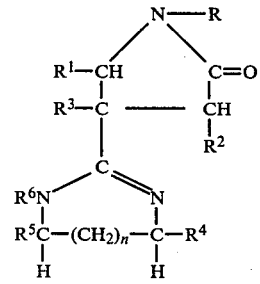

wherein R is a hydrocarbyl radical of from 1 to 12 carbon atoms, an N-mono- or N,N-di-hydrocarbyl substituted aminoalkyl radical wherein each hydrocarbyl moiety and said alkyl moiety contains from 1 to 12 carbon atoms, or an N-butyrolactam alkyl radical containing the substituents $R^1$, $R^2$ and $R^3$ and wherein said alkyl moiety contains from 1 to 12 carbon atoms;

$R^1$ is a hydrocarbon radical of from 1 to 20 carbon atoms;

each of $R^2$ and $R^3$ is a hydrogen atom or a hydrocarbyl radical of from 1 to 500 carbon atoms, provided that only one of $R^2$ and $R^3$ is hydrogen; and only one of $R^2$ and $R^3$ is hydrocarbyl;

each of $R^4$ and $R^5$ is hydrogen or a hydrocarbyl radical of from 1 to 25 carbon atoms;

$R^6$ is a hydrocarbyl radical of from 1 to 25 carbon atoms or an amino alkyl or poly (azaalkyl) radical;
n has a value of 0 to 1 inclusive; and
each of said hydrocarbyl substituents is unsubstituted or substituted.

2. A motor fuel composition as claimed in claim 1, wherein said gasoline boiling range is from about 75° F. to 450° F., and said butyrolactam is present in a concentration of about 0.01 to 0.075 weight percent.

3. A motor fuel composition as claimed in claim 2, wherein $R^3$ is an alkenyl radical of from 8 to 500 carbon atoms.

4. A motor fuel composition as claimed in claim 2, wherein $R^2$ is an alkenyl radical of from 8 to 500 carbon atoms.

5. A motor fuel composition as claimed in claim 2, wherein $R^1$ is phenyl.

6. A motor fuel composition as claimed in claim 2, wherein each of $R^4$ and $R^5$ is a hydrogen atom.

7. A motor fuel composition as claimed in claim 2, wherein $R^6$ is an aminoalkyl radical in which said alkyl group contains from 1 to 6 carbon atoms.

8. A motor fuel composition as claimed in claim 2, wherein $R^6$ is a poly(azaalkyl) radical in which each alkyl moiety contains from 2 to 6 carbon atoms and said azaalkyl moieties recur from 1 to 10 times.

9. A motor fuel composition as claimed in claim 2, wherein R is an N-(butyrolactam) alkyl radical in which said N-(butyrolactam) is a recurring unit.

10. A motor fuel composition as claimed in claim 2, wherein R is a lower alkyl group of from 1 to 6 carbon atoms.

11. A motor fuel composition as claimed in claim 2, wherein R is methyl.

12. A motor fuel composition as claimed in claim 2, wherein R is an N,N-dialkylaminoalkyl substituent.

13. A motor fuel composition as claimed in claim 2, wherein $R^2$ or $R^3$ is an alkenyl radical of from 8 to 300 carbon atoms.

14. A motor fuel composition as claimed in claim 2, wherein R is an N-(butyrolactam) alkyl moiety isomeric or identical to that to which R is attached and said alkyl moiety contains from 1 to 7 carbon atoms.

15. A motor fuel composition as claimed in claim 13, wherein $R^2$ or $R^3$ is a polybutenyl radical.

16. A motor fuel composition as claimed in claim 13, wherein $R^2$ or $R^3$ is a tetrapropenyl radical.

17. A motor fuel composition as claimed in claim 2, wherein n has a value of 0.

18. A motor fuel composition as claimed in claim 2, wherein said butyrolactam is 2(3)-polybutenyl-3-(1'-aminoethyl dihydroimidazolin-2'-yl)-4-phenyl-5-methyl butyrolactam.

19. A motor fuel composition as claimed in claim 2, wherein said butyrolactam is 2(3)-polybutenyl-3-[1'-(3,6,9-triazanonyl)-dihydroimidazolin-2'-yl]-4-phenyl-5-methyl butyrolactam.

* * * * *